US011192691B2

(12) United States Patent
Tamura et al.

(10) Patent No.: US 11,192,691 B2
(45) Date of Patent: Dec. 7, 2021

(54) PACKAGE AND METHOD FOR MANUFACTURING SAME

(71) Applicant: Teijin Limited, Osaka (JP)

(72) Inventors: Masayuki Tamura, Osaka (JP); Takuro Yoneda, Osaka (JP)

(73) Assignee: Teijin Limited, Osaka (JP)

( * ) Notice: Subject to any disclaimer, the term of this patent is extended or adjusted under 35 U.S.C. 154(b) by 256 days.

(21) Appl. No.: 16/345,473

(22) PCT Filed: Aug. 24, 2017

(86) PCT No.: PCT/JP2017/030376
§ 371 (c)(1),
(2) Date: Apr. 26, 2019

(87) PCT Pub. No.: WO2018/079039
PCT Pub. Date: May 3, 2018

(65) Prior Publication Data

US 2019/0276187 A1 Sep. 12, 2019

(30) Foreign Application Priority Data

Oct. 28, 2016 (JP) ..... JP2016-211749

(51) Int. Cl.
*B65D 25/10* (2006.01)
*B65D 81/05* (2006.01)
(Continued)

(52) U.S. Cl.
CPC ..... *B65D 25/10* (2013.01); *B65D 19/44* (2013.01); *B65D 81/05* (2013.01); *B65D 81/051* (2013.01);
(Continued)

(58) Field of Classification Search
CPC ..... B65D 81/05; B65D 25/10; B65D 25/107; B65D 2581/051; B65D 2581/055; B65D 85/62; B65D 19/44
(Continued)

(56) References Cited

U.S. PATENT DOCUMENTS 2,621,807 A * 12/1952 Rendich ..... B23Q 16/001 269/54.5
4,580,680 A 4/1986 Wind
(Continued)

FOREIGN PATENT DOCUMENTS

EP 2607257 A1 6/2013
GB 2293367 A 3/1996
(Continued)

OTHER PUBLICATIONS

Sep. 19, 2017—International Search Report—Intl App PCT/JP2017/030376.
(Continued)

*Primary Examiner* — Steven A. Reynolds
(74) *Attorney, Agent, or Firm* — Banner & Witcoff, Ltd.

(57) ABSTRACT

Provided are: a package that is capable of transporting a composite material without generating fluff by suppressing shedding of carbon fibers from the composite material while holding the composite material at a fixed position during transportation; and a method for manufacturing the package. This package is prepared by stacking a composite material in the form of a plurality of plates on a mounting stand having a plurality of fitting holes, wherein: the composite material includes carbon fibers and a thermoplastic resin; the composite material is held by a plurality of holding members detachably attached to the fitting holes; of the contact surfaces of the composite material and the holding members, one of the contact surfaces of either the composite material
(Continued)

or the holding members is curved, and the other contact surface is flat or curved.

10 Claims, 13 Drawing Sheets

(51) Int. Cl.
*B65D 85/62* (2006.01)
*B65D 19/44* (2006.01)
*B65D 19/18* (2006.01)

(52) U.S. Cl.
CPC ..... *B65D 85/62* (2013.01); *B65D 19/18* (2013.01); *B65D 2581/051* (2013.01); *B65D 2581/052* (2013.01); *B65D 2581/055* (2013.01)

(58) Field of Classification Search
USPC ..... 206/585, 386; 108/55.1, 55.3
See application file for complete search history.

(56) References Cited

U.S. PATENT DOCUMENTS 4,915,033 A * 4/1990 Bond ..... B65D 19/44 108/55.1
4,977,836 A * 12/1990 Bond ..... B65D 19/44 108/55.1
5,809,906 A * 9/1998 Janek ..... B65D 19/0091 108/143
6,598,540 B2 * 7/2003 Austin ..... B65D 19/38 108/51.11
7,966,949 B2 * 6/2011 Willey ..... B60N 3/002 108/44
10,189,601 B2 * 1/2019 Grutt ..... B65D 19/40
2002/0096445 A1 7/2002 Austin et al.
2013/0317161 A1 11/2013 Konagai et al.
2017/0106606 A1 * 4/2017 Toyozumi ..... C08J 5/24

FOREIGN PATENT DOCUMENTS

JP H04-096331 U 8/1992
JP 2001-261042 A 9/2001
JP 2002-145268 A 5/2002
JP 2003-267372 A 9/2003
JP 2006-327640 A 12/2006
JP 2008-174295 A 7/2008
JP 2016-172317 A 9/2016
WO 2012-105080 A1 8/2012

OTHER PUBLICATIONS

Sep. 19, 2019—Written Opinion of the International Search Authority—Intl App PCT/JP2017/030376.
Jul. 8, 2019—(EP) European Search Report—App 17865526.2.

* cited by examiner

PACKAGE AND METHOD FOR MANUFACTURING SAME

CROSS REFERENCE TO RELATED APPLICATIONS

This is a U.S. National Phase Application under 35 U.S.C. § 371 of International Application No. PCT/JP2017/030376, filed Aug. 24, 2017, which claims priority to Japanese Application 2016-211749 filed Oct. 28, 2016, and which was published Under PCT Article 21(2), the entire contents of which are incorporated herein by reference.

TECHNICAL FIELD

The present invention relates to a package in which a plate-shaped composite material is loaded on a mounting board, and a method of manufacturing the package.

BACKGROUND ART

In recent years, in the technical field of machinery, so-called plate-shaped fiber-reinforced composite materials containing thermoplastic resins and carbon fibers is noticed (for example, Patent Document 1). For example, in Patent Document 1, the plate-shaped composite materials are excellent in tensile modulus or tensile strength, impact resistance, and the like because fibers are dispersed in the thermoplastic resin, and are considered as a structural member such as an automobile. These plate-shaped composite materials can be press-molded into a target shape by using compression molding or the like, but when a distance from a manufacture position to a press molding position of the composite materials is far, the composite materials need to be conveyed over a long distance.

On the other hand, various packages or holding devices for mounting articles, which are used when various materials such as industrial products and various components are transported, are known in the related art. For example, Patent Document 2 proposes an article mounting device including an article mounting board in which a plurality of fitting holes are formed in advance such that various forms can be mounted on the article mounting board, and an article holding member that is detachably attached on the mounting board and holds articles mounted on the article mounting board.

CITATION LIST

Patent Document

Patent Document 1: WO 2012/105080
Patent Document 2: JP-A-2002-145268

SUMMARY OF THE INVENTION

Problems to be Solved by the Invention

The shapes of the composite materials to be packed is not only simple shapes such as a square or a rectangle but also a shape that is cut into a target shape in advance according to a shape to be press-molded (hereinafter, the shape of the composite material cut into the target shape may be referred to as a pattern cut shape). When these composite materials each having such a pattern cut shape are packed, it is necessary to prepare holding members and a mounting board for holding the composite materials in accordance with the pattern cut shape, but a large amount of cost and labor is generated to prepare all packing materials in accordance with all pattern cut shapes.

Therefore, it is necessary to use the mounting board corresponding to a plurality of pattern cut shapes in advance such that the composite materials having any pattern cut shape can be packed. However, in the article holding device described in Patent Document 2, a contact surface is formed in a linear shape such that the shape of the holding member conforms to the article, and when the contact surface holds the linear composite materials by using such a holding member, the composite materials are peeled off by the holding member, and the carbon fibers fall off and generate fluff. Such fluff may lead to a serious accident such as a conflagration due to power supply short when such fluff is stirred up in a factory during conveyance or after conveyance.

Accordingly, an object of the present invention is to solve a problem of transport of the composite materials, and to provide a package and a method of manufacturing the package that is capable of transporting the composite materials without generating fluff by suppressing shedding of carbon fibers from the composite materials while holding the composite materials in a fixed position during transport.

Means for Solving the Problem

In order to solve the above problems, the present invention provides the following solutions.

1. A package including:

a mounting board including a plurality of fitting holes;

a plurality of plate-shaped composite materials loaded on the mounting board, the composite materials including carbon fibers and a thermoplastic resin; and a plurality of holding membersdetachably attached to the fitting holes and holding the composite materials, wherein, at contact surfaces between the composite materials and the holding members, one of the contact surfaces of either the composite materials or the holding members is curved, and the other contact surface is flat or curved.

2. The package according to the above 1, wherein the contact surface of the holding members are curved surfaces, and the contact surfaces of the composite materials are flat surfaces or curved surfaces.

3. The package according to the above 2, wherein curvature radii of the curved surfaces of the holding members are 15 mm to 30 mm.

4. The package according to any one of the above 1 to 3, wherein the number of the holding members is smaller than the number of the fitting holes.

5. The package according to any one of the above 1 to 4, wherein the carbon fibers are discontinuous fibers having a weight average fiber length of 1 mm to 100 mm, an orientation state of the carbon fibers is a two-dimensional random arrangement in which the carbon fibers are arranged randomly in an in-plane direction, the composite materials have end surfaces including cross sections of the carbon fibers observed thereon, and surface roughness (Rz) of the end surfaces of each composite material in contact with the holding members is 5 μm or more and 50 μm or less.

6. The package according to the above 5, wherein a carbon fiber fluff amount in the package is 0.5 $g/m^2$ or less.

7. The package according to any one of the above 1 to 5, further including a covering board including insertion holes at positions corresponding to the fitting holes of the mounting board, wherein the plurality of the plate-shaped composite materials are sandwiched and packed between the mounting board and the covering board, and the holding members are inserted into the insertion holes detachably.

8. The package according to the above 7, wherein the covering board and the mounting board have the same shape.

9. The package according to any one of the above 7 or 8, further including:

a frame-shaped side wall in which the mounting board and the covering board are fitted; and a cushioning provided in at least a part of a gap between: outer surroundings of the holding members and the composite members; and the side wall, in between the mounting board and the covering board.

10. The package according to any one of the above 1 to 9, wherein shapes of the plate-shaped composite materials are pattern cut shapes.

11. A method of manufacturing a package, including:

loading a plurality of plate-shaped composite materials including carbon fibers and a thermoplastic resin on a mounting board including a plurality of fitting holes; and detachably attaching one end portions of a plurality of holding members to the fitting holes to hold the composite materials, wherein, at contact surfaces between the composite materials and the holding members, one of the contact surfaces of either the composite materials or the holding members is curved, and the other contact surface is flat or curved.

Effect of the Invention

Generation of fluff caused by falling off of the carbon fibers contained in the composite material can be suppressed.

DESCRIPTION OF EMBODIMENTS

[Carbon Fibers]

1. Summary

Figure 1A:
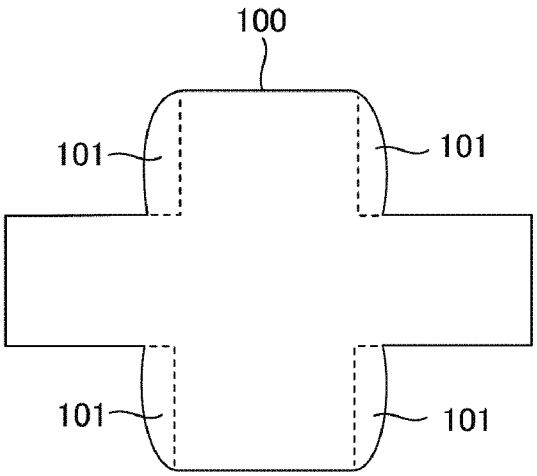
FIG. 1A is a schematic view of a composite material having a pattern cut shape.

Composite materials used in the present invention are not particularly limited, but preferably contain carbon fibers and a thermoplastic resin. Hereinafter, a case where the composite materials contain carbon fibers will be described as a preferred aspect. A type of the carbon fibers can be appropriately selected depending on a type of the thermoplastic resin and a use of the composite materials, and is not particularly limited.

Among them, polyacrylonitrile (PAN) based carbon fibers are preferably used in terms of excellent tensile strength. When the PAN carbon fibers are used as the carbon fibers, the tensile modulus is preferably in a range of 100 GPa to 600 GPa, more preferably in a range of 200 GPa to 500 GPa, and still more preferably in a range of 230 GPa to 450 GPa. The tensile strength is preferably in a range of 2000 MPa to 6000 MPa, and more preferably in a range of 3000 MPa to 6000 MPa.

2. Fiber Length of Carbon Fibers

A fiber length of the carbon fibers can be appropriately selected depending on a type of the carbon fibers or a type of the thermoplastic resin, an orientation state of carbon fibers in the composite material, and the like, and is not particularly limited. Accordingly, continuous fibers or discontinuous fibers may be used depending on the purpose. When the discontinuous fibers are used, a weight average fiber length is preferably in a range of 1 mm to 100 mm. The carbon fibers whose fiber lengths are different from each other may be used together. In other words, the carbon fibers may have a single peak on an average fiber length, or a plurality of peaks.

When the carbon fibers are cut into a certain length by a rotary cutter or the like and used, the cut length corresponds to the average fiber length of the carbon fibers, which is a number average fiber length and a weight average fiber length. When the fiber length of each carbon fiber is Li and the number of measurement is j, the number average fiber length (Ln) and the weight average fiber length (Lw) are calculated by the following formulas (1) and (2) (or the weight average fiber length (Lw) is calculated with the calculation formula (1) of the number average fiber length (Ln) in a case of the certain cut length).

$$Ln=\Sigma Li/j \quad \text{Formula (1)}$$

$$Lw=(\Sigma Li^2)/(\Sigma Li) \quad \text{Formula (2)}$$

3. Fiber Morphology of Carbon Fibers

Examples of the orientation state of the carbon fibers in the composite material may include a unidirectional arrangement in which long axis directions of the carbon fibers are arranged in one direction, and a two-dimensional random arrangement in which the long axis directions are randomly arranged in an in-plane direction of the composite material. The in-plane direction is an XY direction shown in FIG. 5A.

The orientation state of the carbon fibers is preferably a two-dimensional random arrangement randomly arranged in the in-plane direction. In addition, an irregular arrangement (an arrangement state in which the long axis directions of reinforced fibers are not completely arranged in one direction and are not completely random) between the unidirectional arrangement and the two-dimensional random arrangement may be used.

An orientation state of the carbon fibers in the composite material can be confirmed by, for example, performing a tensile test in an arbitrary direction of the composite material and a direction perpendicular thereto, measuring tensile moduli, and then measuring a ratio (Eδ) obtained by dividing a larger one by a smaller one of the measured tensile elastic modulus values. As the ratio of the moduli is closer to 1, it can be evaluated that the carbon fibers are arranged randomly in two dimensions. It is evaluated as isotropic when the ratio obtained by dividing the larger one with the smaller one of modulus values in two orthogonal directions does not exceed 2, and it is evaluated that the isotropy is excellent when the ratio does not exceed 1.3.

4. Volume Content (Vf) of Carbon Fibers

As a preferred aspect, when the composite material contains carbon fibers and a thermoplastic resin, a carbon fiber volume fraction (Vf) contained in the composite material defined by a formula (3), which is not particularly limited, is preferably 5% to 80%, more preferably 10% to 80%, furthermore preferably 10% to 70%, still more preferably 20% to 50%, and most preferably 30% to 40%.

$$100\times(\text{carbon fiber volume})/((\text{carbon fiber volume})+(\text{thermoplastic resin volume})) \quad \text{Formula (3)}$$

If the carbon fiber volume fraction (Vf) is 5% or more, a reinforcing effect is liable to appear sufficiently. On the contrary, if Vf is 80% or less, a void is less likely to occur in the obtained composite material, and physical properties are liable to be improved.

[Thermoplastic Resin]

The thermoplastic resin in the present invention is not particularly limited as long as a composite material having desired strength can be obtained, and can be appropriately selected and used depending on use and the like of the composite material.

The thermoplastic resin having a desired softening point or a melting point can be appropriately selected and used, and those having a softening point in a range of 180° C. to 350° C. are used in general, but the thermoplastic resin is not limited thereto.

Examples of the thermoplastic resin can include a polyolefin resin, a polystyrene resin, a thermoplastic polyamide resin, a polyester resin, a polyacetal resin (polyoxymethylene resin) and a polycarbonate resin, a (meth)acrylic resin, a polyarylate resin, a polyphenylene ether resin, a polyimide resin, a polyether nitrile resin, a phenoxy resin, a polyphenylene sulfide resin, a polysulfone resin, a polyketone resin, a polyetherketone resin, a thermoplastic urethane resin, a fluororesin, a thermoplastic polybenzimidazole resin, and a vinyl resin.

Examples of the polyolefin resin can include a polyethylene resin, a polypropylene resin, a polybutadiene resin, and a polymethylpentene resin.

Examples of the vinyl resin can include a vinyl chloride resin, a vinylidene chloride resin, a vinyl acetate resin, and a polyvinyl alcohol resin.

Examples of the polystyrene resin can include a polystyrene resin, an acrylonitrile-styrene resin (AS resin), and an acrylonitrile-butadiene-styrene resin (ABS resin).

Examples of the polyamide resin can include a polyamide 6 resin (nylon 6), a polyamide 11 resin (nylon 11), a polyamide 12 resin (nylon 12), a polyamide 46 resin (nylon 46), a polyamide 66 resin (nylon 66), and a polyamide 610 resin (nylon 610).

Examples of the polyester resin can include a polyethylene terephthalate resin, a polyethylene naphthalate resin, a polybutylene terephthalate resin, a polytrimethylene terephthalate resin, and liquid crystal polyester. Examples of the (meth)acrylic resin can include polymethyl methacrylate.

Examples of the polyphenylene ether resin can include modified polyphenylene ether. Examples of the thermoplastic polyimide resin can include a thermoplastic polyimide, a polyamidimide resin, and a polyetherimide resin. Examples of the polysulfone resin can include a modified polysulfone resin and a polyether sulfone resin.

Examples of the polyether ketone resin can include a polyether ketone resin, a polyether ether ketone resin, and a polyether ketone ketone resin. Examples of fluororesin can include polytetrafluoroethylene.

The thermoplastic resin used in the present invention may be only one type or two or more types. Examples of an aspect in which two or more types of the thermoplastic resin are used in combination can include an aspect in which thermoplastic resins having a different softening point or melting point from each other are used in combination or an aspect in which thermoplastic resins having different average molecular weight from each other are used in combination, but are not limited thereto.

[Other Agents]

The composite material used in the present invention may contain additives such as various fibrous or non-fibrous fillers, flame retardants, UV-resistant agents, stabilizers, release agents, pigments, softening agents, plasticizers, and surfactants of organic fibers or inorganic fibers in a scope that does not impair the object of the present invention.

[Method of manufacturing composite material]

The composite material used in the present invention can be manufactured by using a generally known method, and for example, an isotropic substrate described in WO 2012/105080 Pamphlet and US 2013/0317161 is preferably used. In the composite material using the isotropic substrate, carbon fibers are not oriented in a specific direction in a plane of the composite material, but are dispersed in a random direction.

[Shapes of Composite Materials]

The shapes of the composite materials in the present invention are preferably pattern cut shapes.

In the present specification, a shape of the composite material obtained by cutting into a target shape in advance to facilitate molding is referred to as a pattern cut shape. In addition to a simple shape such as a square or a rectangle, the composite material is cut into a target shape in advance in accordance with a shape to be press-molded.

Figure 1B:
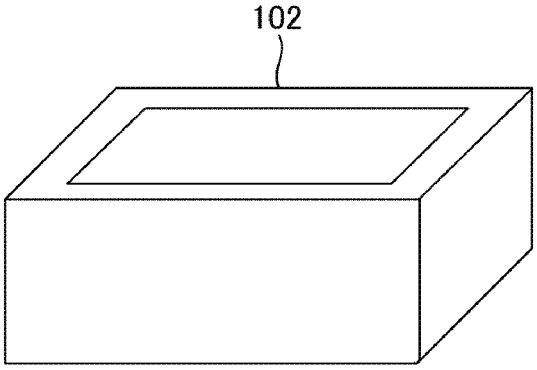
FIG. 1B is a schematic view of a molded article molded using the composite material of FIG. 1A.

The molded article is easily molded into a target shape by cutting the composite material into the target shape in advance. For example, when a box type molded article 102 as shown in FIG. 1B is manufactured, the composite material 100 cut into a pattern as shown in FIG. 1A may be used. 101*s* in FIG. 1A are tabs for sticking at the time of molding (when a molded article is produced).

[Package]

A plurality of plate-shaped composite materials are loaded on a mounting board including a plurality of fitting holes.

1. Mounting Board

A raw material of the mounting board and the holding members is not particularly limited, but is preferably a cardboard from the aspect of cost. For example, the plurality of fitting holes 202 are formed in the mounting board 201 in FIG. 2. Although the fitting holes 202 shown here may penetrate the mounting board 201, the fitting holes 202 may be formed as a hole at the bottom by forming a depth of the fitting hole 202 shallower than a thickness of the mounting board 201.

2. Fitting Hole and Holding Member

Figure 3:
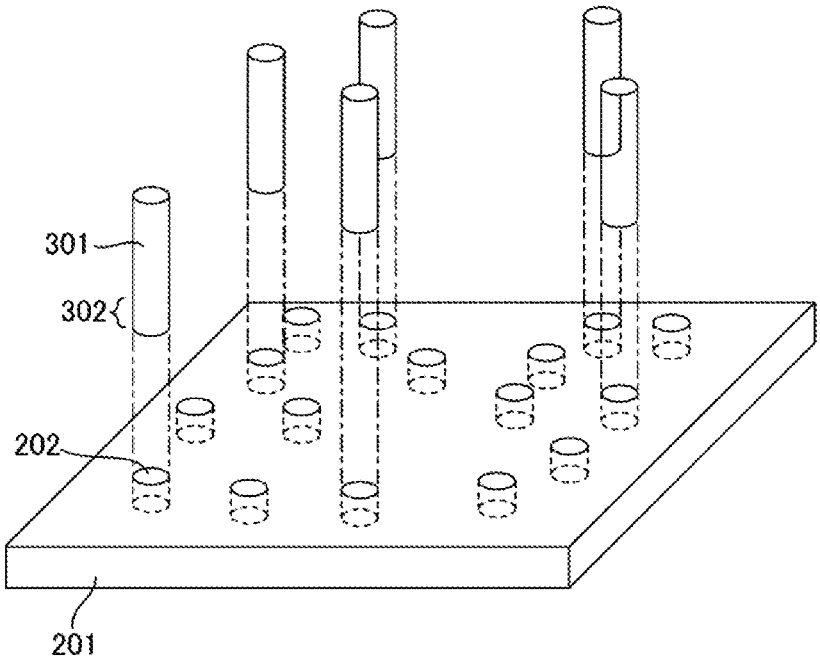
FIG. 3 is a schematic view showing a state in which a holding member is attached to the mounting board.

A plurality of holding members are detachably attached to the fitting holes 202 in the present invention. As shown in FIG. 3, in one of the holding members holding the composite material as a holding member 301, an attachment region 302 detachably attached to the fitting hole 202 is formed integrally on one end portion, and the holding member 301 holds the composite material through an end surface of the composite material loaded on the mounting board, as shown in FIGS. 3 to 10.

As shown in FIG. 3, by lowering the attachment region 302 to lower the holding member 301 downward, the attachment region 302 can be fitted into an arbitrary fitting hole 202, and the holding member 301 can be attached to the mounting board 201. If the holding member 301 is raised upward, the attachment region 302 can be disconnected from the fitting hole 202, and the holding member 301 can be detached from the mounting board 201.

Figure 4:
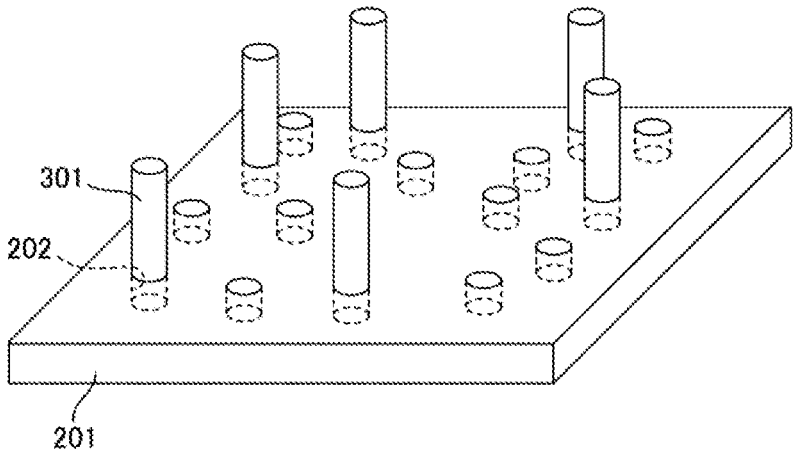
FIG. 4 is a schematic view of the mounting board including a plurality of holding members to which one end is detachably attached.
Figure 5A:
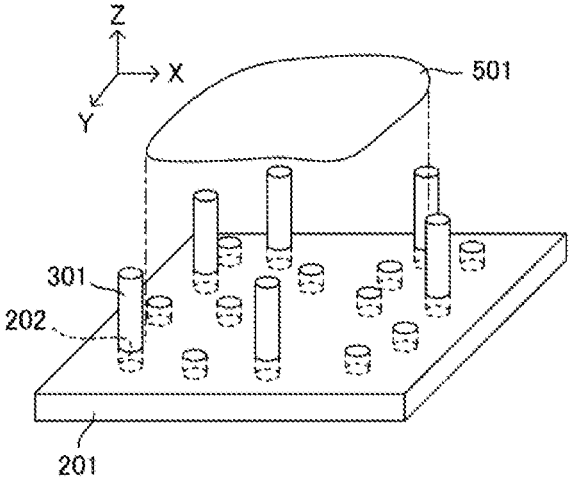
FIGS. 5A and 5B are schematic views in which a plate-shaped composite material (one piece) is mounted on the mounting board.
Figure 5B:
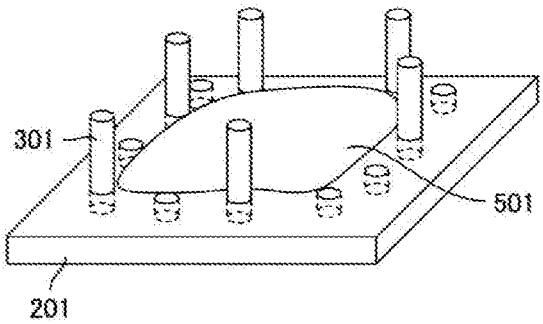

In order to load and hold the composite material on the mounting board for a purpose of transporting the composite material, for example, as shown in FIG. 3 and FIG. 4, the attachment regions 302 of the plurality of holding members 301 are fitted into the fitting holes 202 selected according to a shape of the composite material, and as shown in FIG. 5A to FIG. 5B, the composite material 501 is lowered from an upside of the mounting board 201, and the composite material 501 is loaded on the mounting surface of an upper surface of the mounting board 201. At this time, the holding surface (contact surface) of each holding member 301 abuts on or is located in proximity to an end surface of the composite material 501, and can position and hold the composite material 501.

After the composite material 501 is loaded on the upper surface of the mounting board 201, the attachment regions 302 of the plurality of holding members 301 may be fitted into the fitting holes 202 to hold the composite material 501 by the holding members 301.

Figure 5C:
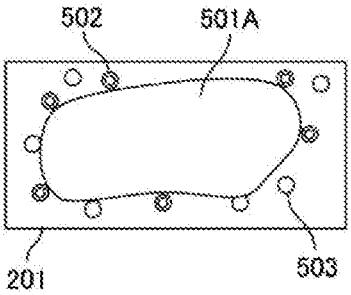
FIG. 5C is a plan view seen from the top when the plate-shaped composite material is mounted.
Figure 5D:
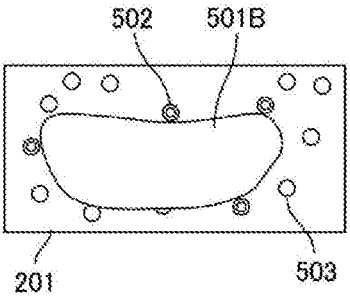
FIG. 5D is a plan view in which a composite material having a pattern cut shape different from that of FIG. 5C is mounted on the mounting board.

As a specific example, FIG. 5C schematically shows a state when the composite material 501A having a pattern cut shape loaded on the mounting board is held by six holding members 301. Since the holding member 301 and the composite material 501 abut each other or are located in close proximity, there is no need to dispose a spacer therebetween.

As shown in the specific example of FIG. 5C, the holding member 301 is attached to 502 (a double circle) in FIG. 5, but the holding member 301 is not attached to 503 (a single circle) in FIG. 5. This is because producing a mounting board which can correspond to all pattern cut shapes in advance is preferable on work than preparing a mounting board according to the pattern cut shape, and when the composite material pattern-cut into a different shape is mounted, the fitting hole to which the holding member 301 is attached as shown in FIG. 5D is different from that in FIG. 5C. FIG. 5D is a schematic view in which a composite material 501B having a pattern cut shape different from that of FIG. 5C is loaded. Since the pattern cut shape is different, an attachment position of the holding member 301 is different from that in FIG. 5C. The mounting board 201 is preferably provided with fitting holes 202 so as to hold the composite material having all pattern cut shapes, and therefore the number of the holding members 301 is preferably smaller than the number of the fitting holes 202.

3. Shape of Holding Member

In the package in the present invention, in contact surfaces between the composite material and the holding member, a contact surface of either the composite material or the holding member is a curved surface, and the other contact surface is a flat surface or a curved surface. The "contact surfaces between the composite material and the holding member" referred to herein have at least one contact surface of a plurality of contact surfaces, in which the contact surface of either the composite material or the holding member may be a curved surface, and the other contact surface may be a flat surface or a curved surface. Accordingly, the carbon fibers do not fall off from the composite material, the fluff of the carbon fibers is stirred up in a factory during conveyance or after conveyance, and a possibility leading to a serious accident, such as a conflagration due to a power supply short can be suppressed.

The contact surface in the present invention is illustrated in FIGS. 11A to 11G. Conversely, when the holding member 301 holding the composite material 501 contacts at the point of an apex angle as shown in FIGS. 12A to 12C, even if the contact surface of the composite material 501 is a curved surface, the carbon fibers easily fall off from an end portion of the composite material 501. Similarly, as in shapes of FIGS. 12D to 12F, even when both of the contact surfaces between the holding member 301 and the composite material 501 have a planar shape (the contact surfaces are drawn in a linear shape since the drawings are top view), the composite material 501 and the holding member 301 rub against each other during conveyance, and the carbon fibers fall off from the composite material 501.

In the contact surface between the composite material and the holding member in the present invention, the contact surface of the holding member is preferably a curved surface, and the contact surface of the composite material is preferably a flat surface or a curved surface. As shown in FIG. 11E, even if the contact surface on the composite material 501 side has a linear shape, if the contact surface of the holding member 301 is a curved surface, shape flexibility of the pattern cut shape of the composite material 501 increases since generation of the fluff of the carbon fibers can be suppressed effectively.

Figure 11A:
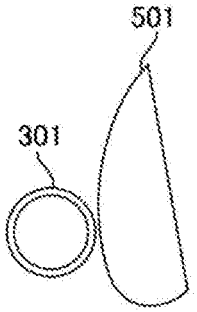
FIGS. 11A to 11G are examples showing a contact surface between the composite material and the holding member in the present invention.
Figure 11B:
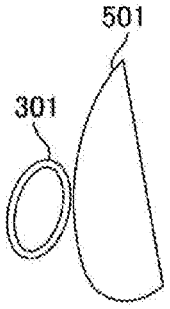
Figure 11C:
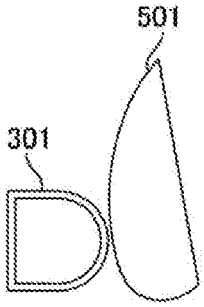
Figure 11D:
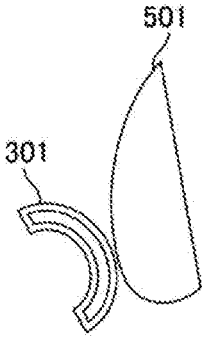
Figure 11E:
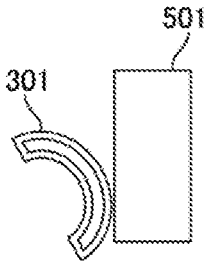
Figure 11F:
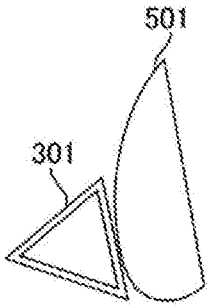
Figure 11G:
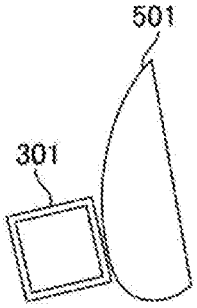
Figure 12A:
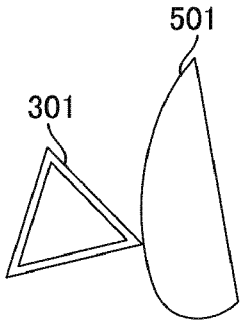
FIGS. 12A to 12F are examples showing a contact surface between the composite material and the holding member which is liable to generate fluff.
Figure 12B:
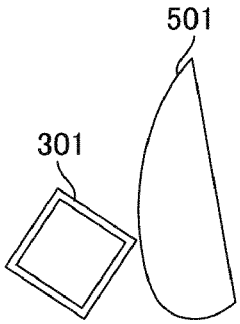
Figure 12C:
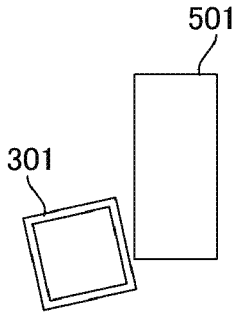
Figure 12D:
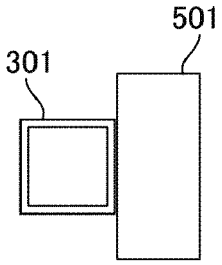
Figure 12E:
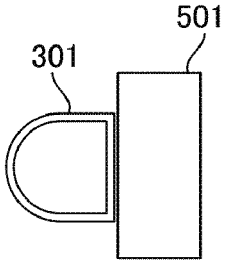
Figure 12F:
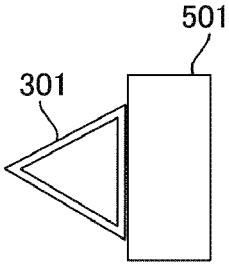

When the contact surface of the holding member 301 is a curved surface, a curvature radius of the curved surface is more preferably 15 mm to 30 mm, and the holding member 301 even more preferably has a cylindrical shape (shape in FIG. 11A, the holding member 301 has a circular shape in a top view).

4. Covering Board

Figure 6:
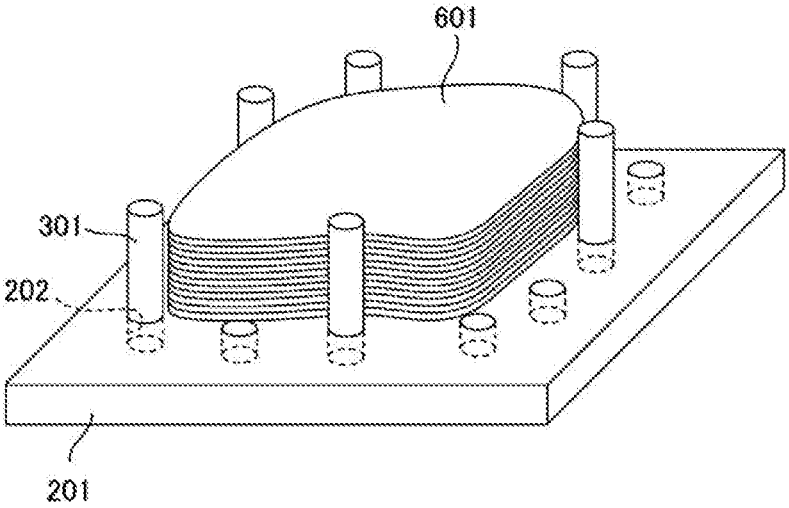
FIG. 6 is a schematic view in which a plurality of plate-shaped composite materials are loaded.
Figure 7:
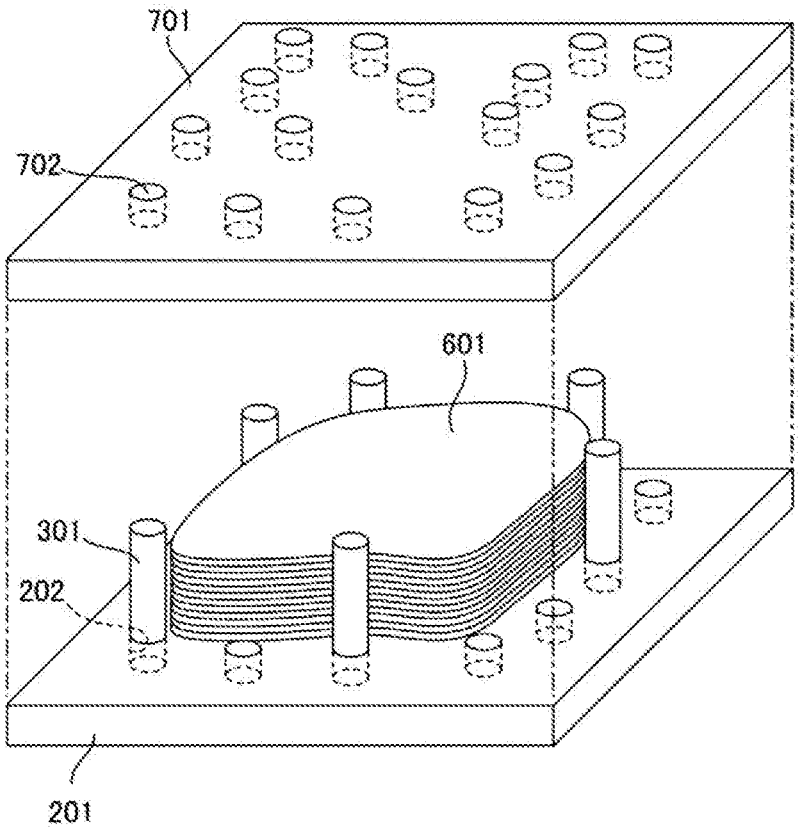
FIG. 7 is a schematic view showing a state to be covered with a covering board.
Figure 8:
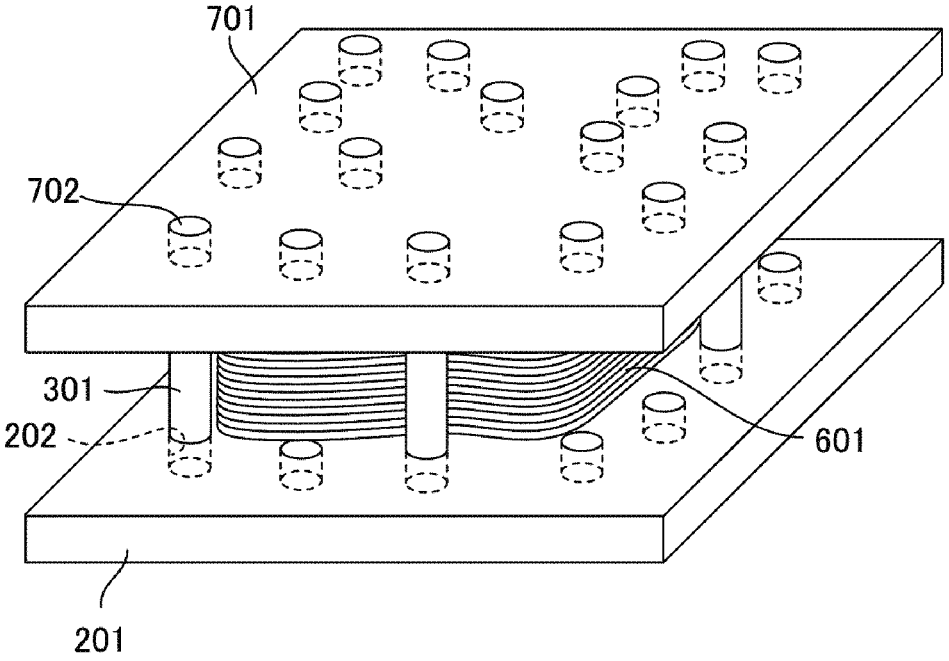
FIG. 8 is a schematic view showing a state covered with the covering board.

As shown in FIG. 6, a length of the holding member 301 is set such that the height of the holding member 301 attached to the fitting hole 202 from the upper surface of the mounting board is higher than a height of the loaded composite material 601 from the upper surface of the mounting board, and the covering board 701 is covered on the holding member 301 to form a more stable package (FIG. 7 and FIG. 8). If the covering board 701 is provided in this manner, a package (not illustrated) can be placed in a stable state on the covering board 701, and the package can be stacked vertically.

Although an appropriate aspect can be used as the covering board 701, in the package in the present invention, it is preferable that a plurality of plate-shaped composite materials are sandwiched between the covering board 701 and the mounting board 201 and packed, and that the covering board 701 has insertion holes 702 at positions corresponding to the fitting holes 202 of the mounting board 201 and the holding members 301 are detachably inserted into the insertion holes 702. Incidentally, it is the other end portion on a side opposite to one end portion of the holding member 301 attached to the fitting hole 202 that is inserted into the insertion hole 702. Accordingly, the covering board 701 can be easily and accurately attached to an upper portion of the holding member 301. When the covering board 701 and the mounting board 201 have the same shape, it is preferable to manufacture the package.

5. Cushioning

Figure 9A:
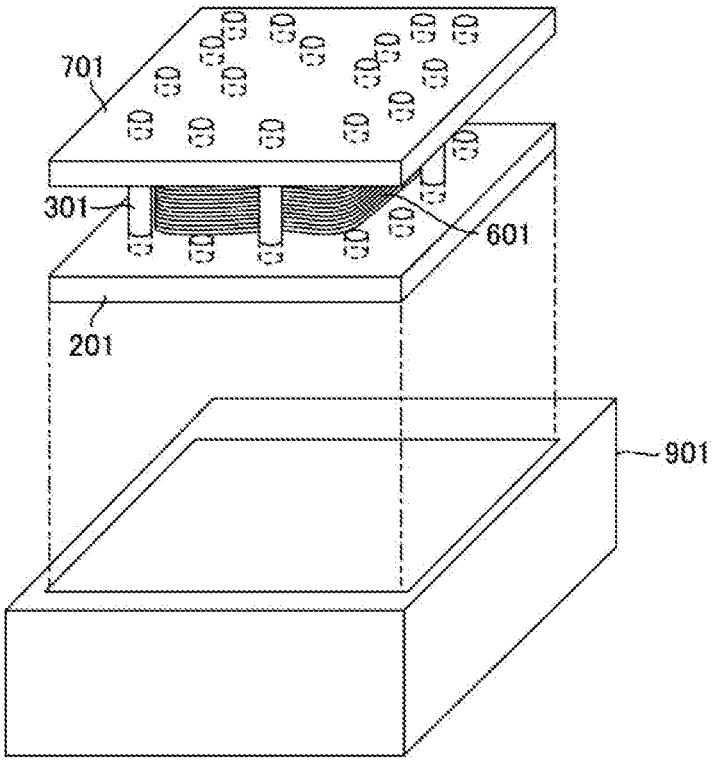
FIG. 9 is a schematic view showing an encased state such that the composite material can be sealed.
Figure 9B:
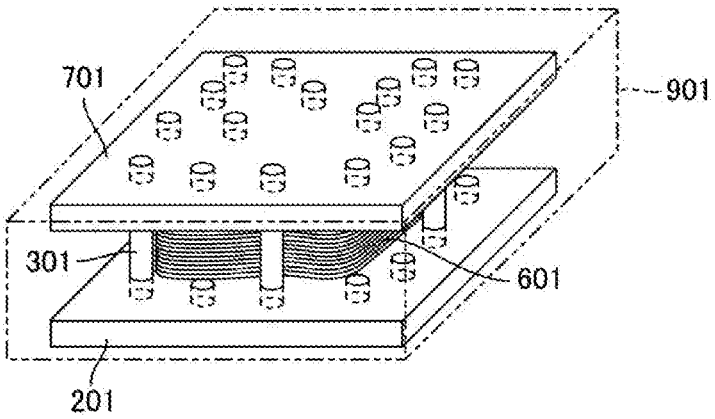
Figure 10:
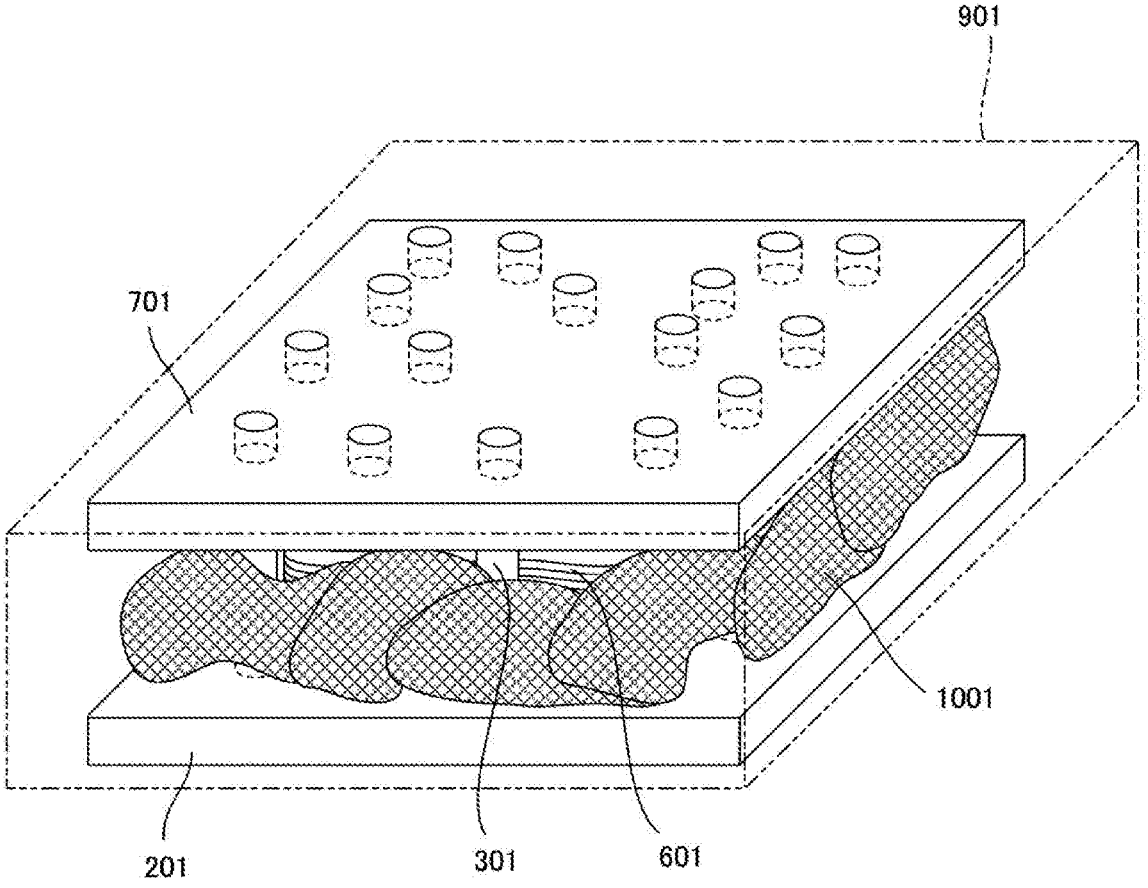
FIG. 10 is a schematic view showing a state in which a cushioning is contained in the package.

The package in the present invention preferably includes cushioning 1001. The cushioning 1001 is preferably provided in at least a part of a gap between: outer surroundings of the holding member 301 and the composite members 601; and the side wall 901 of the box, in between the mounting board 201 and the covering board 701 as shown in FIG. 10, in view of preventing slippage when the cushioning 1001 is packed in a box having a frame-shaped side wall 901 in which the mounting board 201 and the covering board 701 are sealably fitted as shown in FIG. 9A to 9B, and is more preferably filled in the gap.

The cushioning 1001 may be an elastic member made of, for example, rubber or soft resin, or an air cushion such as a bubble-containing cushioning.

When such a cushioning 1001 is provided, for example, even the package is oblique when the package is transported, the holding member 301 and the composite members 601 are supported by the side wall 901 via the cushioning 1001, stress is not concentrated on the holding member 301, stress is relieved by the cushioning 1001, and a defect that the composite material 601 is scratched can be prevented.

6. Fluff Amount of Carbon Fibers

A fluff amount of carbon fibers in the package in the present invention is preferably 0.5 $g/m^2$ or less, more preferably 0.3 $g/m^2$ or less, and even more preferably 0.1 $g/m^2$ or less.

In the composite material in the present invention, surface roughness (Rz) of an end surface of the composite material in contact with the holding member is preferably 5 μm or more and 50 μm or less. The end surface of the composite material is preferably excellent in surface property, particularly smoothness in view of preventing generation of a fluff amount of the carbon fibers. The surface roughness (Rz) of the composite material is 50 μm or less, so that peeling off and burrs are hardly generated on the end surface, and the fluff generation of the carbon fibers due to friction with the holding member can be prevented. The surface roughness (Rz) is preferably 30 μm or less, more preferably 25 μm or less, still more preferably 15.0 μm or less. Conversely, for example, if the surface roughness is larger than 5 μm, the adhesive is liable to penetrate into the end surface when the end surface is bonded to another member using an adhesive, so that an anchoring effect of the adhesive surface (end surface) can often be sufficiently exhibited.

7. Package

The package in the present invention refers to a package in which the stacked composite materials are held on the mounting board via the holding members, and therefore, for example, that shown FIG. 6 is a package.

However, as a preferred embodiment, that provided with a covering board (for example, FIG. 8) or that packed in a box to be sealable (for example, FIGS. 9 and 10) is the package in the present invention.

[Transport of Package]

When the package is transported, for example, forks of a forklift can be inserted from a downside of the mounting board, and the package can be raised and conveyed by placing the package on a truck or the like. At this time, since the composite materials on the mounting board are held by the plurality of holding members in their surroundings, the composite materials can be transported in a stable state.

After the composite materials are transported to a conveyance destination, the holding members can be separated and returned to original places after the composite materials are arrived, and when the mounting board, the holding members, or the like is produced with a cardboard, they can be discarded at the conveyance destination.

As described above, the package of the present invention includes a mounting board in which the plurality of fitting holes are formed and holding members detachably attached to the fitting holes to hold the composite materials. Therefore, whatever the size or form of the composite materials is, the fitting holes are selected in accordance therewith, and the holding members are attached to the fitting holes, so that surroundings of the composite materials even having various pattern cut shapes can be held by the holding members.

Figure 2:
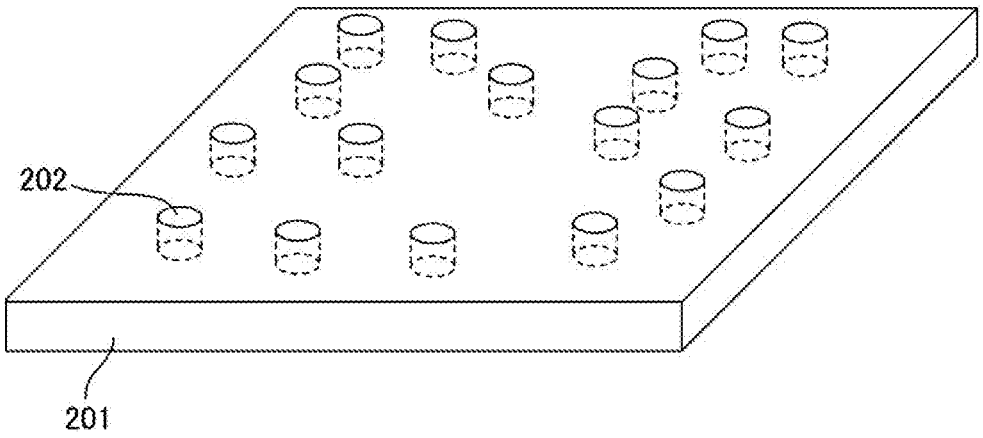
FIG. 2 is a schematic view of a mounting board including fitting holes.

Further, as shown in FIG. 2, the shapes and sizes of the fitting holes 202 formed in the mounting board 201 are preferably formed substantially the same in all the fitting holes 202. In this way, the attachment regions 302 of the holding members 301 can be easily fitted into any of the fitting holes 202 and easily pulled out from the fitting holes 202, and attachment/detachment works of the holding members 301 can be easily performed.

Figure 13A:
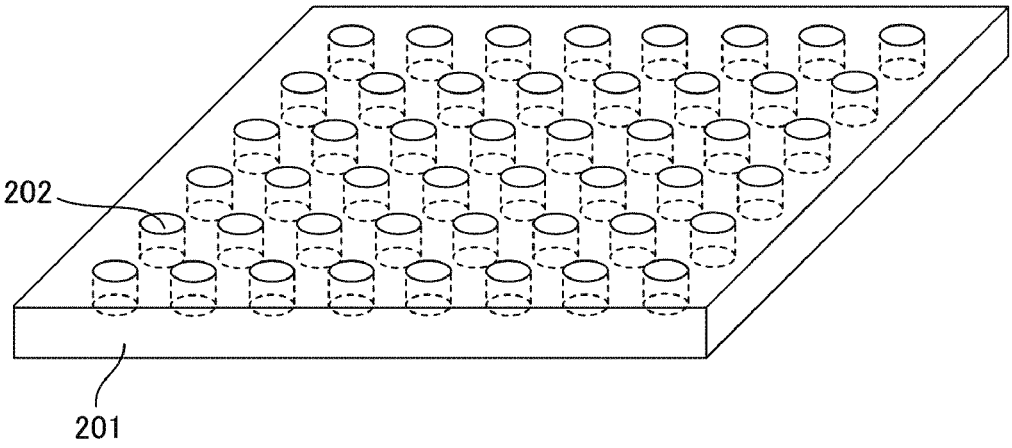
FIGS. 13A and 13B are schematic views of a modification of the mounting board of FIG. 2.
Figure 13B:
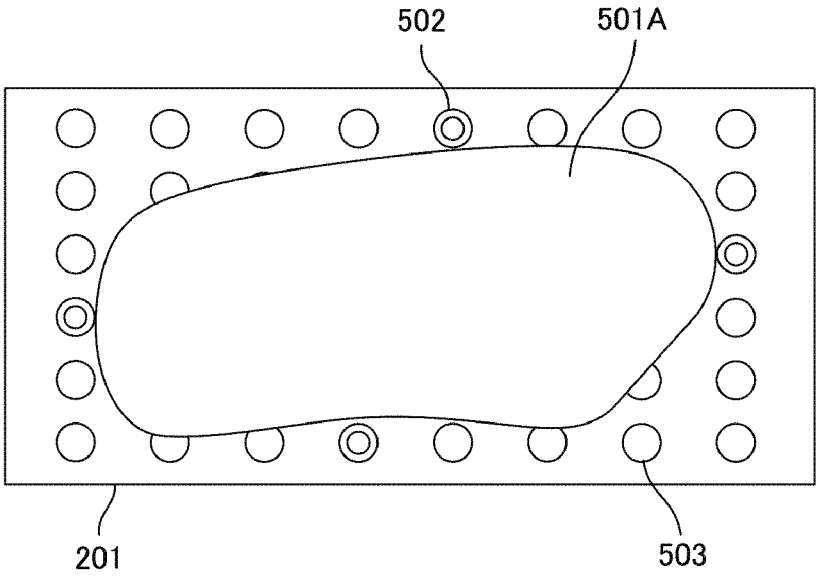

In the example shown in FIG. 2, the plurality of fitting holes 202 are formed in only a specific region of the upper surface of the mounting board 201, but the plurality of fitting holes 202 may be formed in an entire region on the mounting board, for example, the plurality of fitting holes 202 may be formed in a matrix form in an entire region on the mounting board as shown in FIG. 13A. FIG. 13B shows a case where the composite materials 501A having the pattern cut shape shown in FIG. 5C are mounted on the mounting board 201 in which the plurality of fitting holes 202 are provided in a matrix form, and in FIG. 13B, the holding members are attached to 502 (the double circles), and the holding members are not attached to 503 (the single circles). In this way, by attaching the holding members to the fitting holes selected according to the shape of the composite materials, it is possible to hold the composite materials having all pattern cut shapes.

[Compression Molding]

The composite material in the present invention is taken out from the package and then press-molded to form a press molded article. As a preferable molding method, compression molding using a cold press or a hot press is used.

(Cold-Press Method)

In a cold-press method, for example, the composite material heated to a first predetermined temperature is put into molds at a second predetermined temperature, and then pressurized and cooled. That is, the cold-press method includes at least the following step A-1) to step A-3).

Step A-1): A step of heating the composite material to a softening temperature or higher of the thermoplastic resin contained in the composite material.

Step A-2): A step of disposing the heated composite material obtained in the above step A-1) in molds in which a temperature of the thermoplastic resin is adjusted lower than a softening temperature.

Step A-3): A step of pressurizing and molding the composite material disposed in the molds in the above step A-2).

By performing these steps, molding of the composite material can be completed.

(Hot-Press Method)

A hot-press method includes at least the following step B-1) to step B-3).

Step B-1): A step of disposing the composite material in molds Step B-2): A step of heating the molds to a softening temperature or higher of the thermoplastic resin and pressurizing the molds Step B-3): A step of adjusting a temperature of the molds to be lower than the softening point of the thermoplastic resin to mold the molds (With Regard to Common Items for Both Press Methods)

When the composite material is put into the molds, the composite material is used alone (one piece) or a plurality of pieces in accordance with a plate thickness of a target molded article. When a plurality of pieces are used, the plurality of pieces may be laminated and heated in advance, the heated composite material may be put into the molds after being laminated, or the heated composite material may be laminated in order in the molds. It is good that a temperature difference between the lowermost composite material and the uppermost composite material when laminated is small, and in view of this, it is preferable to laminate them before putting them into the molds.

The above steps needs to be performed in the above order, but may include other steps between the steps. Other steps include, for example, a preliminary shaping step of shaping the composite material into a shape of a cavity of the molds in advance by using the molds used in the step A-3) or the step B-2) and other shaping devices before the step A-3) or the step B-2).

The step A-3) or step B-2) is a step of obtaining a molded article having a desired shape by applying pressure to the composite material. A molding pressure at the step is not particularly limited, and is preferably less than 30 MPa, more preferably 20 MPa or less, and even more preferably 10 MPa or less with respect to a cavity projection area of the molds.

As a matter of course, various steps may be performed between the above steps during press molding, and vacuum compression molding in which press molding is performed, for example, under vacuum may be used.

EXAMPLES

[Methods for Evaluation and Analysis]

Examples are shown below, but the present invention is not limited thereto. Values in this example were determined according to the following method.

[Preparation of Raw Materials]

Raw materials used in the present invention are as follows.

(Preparation of Composite Material)

Except that: carbon fibers "Tenax" (registered trademark) ST40-24KS (average fiber diameter: 7 μm) manufactured by Toho Tenax which was treated with a nylon sizing agent was used as reinforced fibers; and nylon 6 resin A1030 (melting point: 230° C.) manufactured by Unitika Ltd. was used as a thermoplastic resin, an isotropic material was produced based on a method described in Example 1 of WO 2012/105080 Pamphlet (US 2013/0317161). The isotropic material was preheated at 240° C. for 90 s and then hot-pressed at 240° C. for 180 s while applying a pressure of 2.0 MPa. Next, the composite material was cooled to 50° C. in a pressurized state to obtain a flat plate having a carbon fiber volume fraction Vf of 35%, a weight average fiber length of carbon fibers of 20 mm, and a plate thickness of 2 mm (Cut into Pattern Cut Shape)

The obtained composite material was cut into a pattern cut shape as 501 in FIG. 5A. Surface roughness (Rz) on an end surface of the composite material cut into the pattern cut shape was measured at four points, and an average value was 13.1 μm.

(Mounting Board)

A mounting board provided with circular fitting holes as shown in FIG. 3 was prepared using a cardboard. The mounting board had an area of 1.5 m×0.7 m and a thickness of 0.16 m. Further, beams were provided in the mounting board and prepared so as to withstand up to eight tons. Each circular fitting hole had a diameter of 0.046 m and a depth of 0.14 m.

(Holding Members)

Six cylindrical paper tubes as shown in 301 of FIG. 3 were prepared as holding members. A cylinder of the holding member had an outer diameter of 0.046 m, an inner diameter of 0.034 m, and a height of 0.44 m. Since the holding members were pierced into the fitting holes, the holding members protruded 0.30 m upward from the mounting board.

(Covering Board)

Another one similar to the mounting board was prepared and used as a covering board.

Example 1

As shown in FIG. 2 to FIG. 10, the composite materials cut into the pattern cut shape were packed in a box sealably, and a package in which cushioning was filled all over was manufactured.

The package was transported with a truck for five kilometers in a factory. and when the package was opened, an amount of carbon fiber fluff contained in the package was measured to be 0.10 g. Since a size of the mounting board is 1.5 m×0.7 m (1.05 $m^2$), when divided with this value, the fluff amount of carbon fibers contained in the package is 0.095 $g/m^2$.

INDUSTRIAL APPLICABILITY

The package and the method of manufacturing the same according to the present invention can be suitably used for transporting plate-shaped composite materials containing carbon fibers and a thermoplastic resin.

Although the embodiments and examples of the present invention have been described in detail, this is only an example, and the present invention can be implemented in an aspect in which various modifications are applied in a scope not departing from the spirit. The present application is based on Japanese Patent Application No. 2016-211749 filed on Oct. 28, 2016, contents of which are incorporated herein as reference.

DESCRIPTION OF REFERENCE NUMERALS

100 composite material
101 tab for sticking
102 molded article
201 mounting board
202 fitting hole
301 holding member
302 mounting region
501, 501A, 501B plate-shaped composite material

502 used fitting hole (double circle)
503 non-used fitting hole (single circle)
601 loaded plate-shaped composite material
701 covering board
702 insertion hole
901 side wall
1001 cushioning

The invention claimed is:

1. A package comprising:

a mounting board including a plurality of fitting holes;

a plurality of plate-shaped composite materials loaded on the mounting board, the composite materials including carbon fibers and a thermoplastic resin; and a plurality of holding members having respective one end portions detachably attached to the fitting holes and holding the composite materials; and a covering board contacting and sandwiching the plurality of the plate-shaped composite materials between the mounting board and including insertion holes at positions corresponding to the fitting holes of the mounting board, other end portions of the holding members opposite to the one end portions are detachably inserted in the insertion holes, and the covering board is attached to the other end portions inserted in the insertion holes;

wherein, at contact surfaces between the composite materials and the holding members, one of the contact surfaces of either the composite materials or the holding members is curved, and the other contact surface is flat or curved.

2. The package according to claim 1, wherein the contact surfaces of the holding members are curved surfaces, and the contact surfaces of the composite materials are flat surfaces or curved surfaces.

3. The package according to claim 2, wherein curvature radii of the curved surfaces of the holding members are 15 mm to 30 mm.

4. The package according to claim 1, wherein the number of the holding members is smaller than the number of the fitting holes.

5. The package according to claim 1, wherein the carbon fibers are discontinuous fibers having a weight average fiber length of 1 mm to 100 mm, an orientation state of the carbon fibers is a two-dimensional random arrangement in which the carbon fibers are arranged randomly in an in-plane direction, the composite materials have end surfaces including cross sections of the carbon fibers observed thereon, and surface roughness (Rz) of the end surfaces of each composite material in contact with the holding members is 5 μm or more and 50 μm or less.

6. The package according to claim 5, wherein a carbon fiber fluff amount in the package is 0.5 $g/m^2$ or less.

7. The package according to claim 1, wherein the covering board and the mounting board have the same shape.

8. The package according to claim 1, further comprising:

a frame-shaped side wall in which the mounting board and the covering board are fitted; and a cushioning provided in at least a part of a gap between: outer surroundings of the holding members and the composite materials; and the side wall, in between the mounting board and the covering board.

9. The package according to claim 1, wherein shapes of the plate-shaped composite materials are pattern cut shapes.

10. A method of manufacturing a package, comprising:

loading a plurality of plate-shaped composite materials including carbon fibers and a thermoplastic resin on a mounting board including a plurality of fitting holes; and detachably attaching one end portions of a plurality of holding members to the fitting holes to hold the composite materials;

contacting and sandwiching the plurality of the plate-shaped composite materials between the mounting board and a covering board including insertion holes at positions corresponding to the fitting holes of the mounting board;

inserting other end portions of the holding members in the insertion holes; and attaching the covering board to the other end portions inserted in the insertion holes, wherein, at contact surfaces between the composite materials and the holding members, one of the contact surfaces of either the composite materials or the holding members is curved, and the other contact surface is flat or curved.

* * * * *